US007111747B2

(12) United States Patent
Paikin et al.

(10) Patent No.: US 7,111,747 B2
(45) Date of Patent: Sep. 26, 2006

(54) SYSTEM AND METHOD FOR ABSORBING LIQUIDS ON OUTSIDE OF BOTTLE NECKS

(75) Inventors: Mark Paikin, Fayetteville, NY (US); Cindy Paikin, Fayetteville, NY (US)

(73) Assignee: Cynmark Designs, LLC, Fayetteville, NY (US)

( * ) Notice: Subject to any disclaimer, the term of this patent is extended or adjusted under 35 U.S.C. 154(b) by 368 days.

(21) Appl. No.: 10/729,395

(22) Filed: Dec. 5, 2003

(65) Prior Publication Data

US 2005/0121410 A1 Jun. 9, 2005

(51) Int. Cl.
*B65D 23/06* (2006.01)

(52) U.S. Cl. ..... 215/392; 215/388; 215/394; 222/108; 222/571

(58) Field of Classification Search ..... 215/388, 215/392, 394, 41; 222/108, 571; 229/89; 220/731

See application file for complete search history.

(56) References Cited

U.S. PATENT DOCUMENTS 1,438,706 A * 12/1922 Hegenberg ..... 222/108
1,497,740 A * 6/1924 Schenkein ..... 215/288
1,759,176 A * 5/1930 Voorhees ..... 215/12.1
2,815,909 A * 12/1957 Paprocki et al. ..... 248/102
2,841,349 A * 7/1958 Charles ..... 248/104
3,063,590 A * 11/1962 Hopkins ..... 215/392
3,890,449 A * 6/1975 Mezquita ..... 426/127
5,459,903 A * 10/1995 Treacy ..... 24/3.13
5,687,879 A * 11/1997 King et al. ..... 222/108
6,029,870 A * 2/2000 Giacona, III ..... 224/148.6
6,131,780 A * 10/2000 Becker ..... 224/148.6

* cited by examiner

*Primary Examiner*—Sue A. Weaver
(74) *Attorney, Agent, or Firm*—George R. McGuire; Bond, Schoeneck & King, PLLC

(57) ABSTRACT

An article of manufacture is placed in cooperative relationship with a liquid-containing bottle, such as a wine bottle, to absorb liquid which runs down the neck of the bottle. The article comprises a length of flexible cord with opposite ends passed through closely spaced, laterally adjacent passageways of a retaining member to form a closed loop on one side of the retaining member and the cord extending to free ends on the other side. The closed loop is placed around the bottle neck and the retaining member, which is in frictional engagement with the cord, is moved to essentially remove slack from the closed loop. The retaining member then rests upon the bottle neck and the free ends extend down the bottle base. Weight members may be attached to the free ends of the cord after passing through the passageways.

5 Claims, 4 Drawing Sheets

SYSTEM AND METHOD FOR ABSORBING LIQUIDS ON OUTSIDE OF BOTTLE NECKS

BACKGROUND OF THE INVENTION

The present invention relates to absorbing wine or other liquids which may run down the exterior surface of a bottle neck following pouring of the liquid from the bottle. More specifically, the invention relates to the combination with a bottle having a base and a neck portion of a liquid-absorbing material to essentially eliminate liquid from flowing past a position relatively high on the exterior surface of a bottle neck after pouring liquid from the opening at the top of the bottle neck.

Various means have been employed to absorb liquid on the exterior surface of a bottle, particularly liquid which may run down the surface of a bottle neck after pouring a portion of the bottle's contents into a glass and prior to pouring an additional portion or the remainder of the bottle's contents. Such situations arise most frequently in connection with the pouring of wine. A napkin or other cloth is often held or tied around the bottle neck to absorb droplets of wine which run down the outside of neck between pouring operations.

It is a principal object of the present invention to provide novel and improved structure and methods of absorbing liquid which runs down the outside of a bottle after tipping the bottle to pour out a portion of its contents and returning the bottle to an upright position.

A further object is to provide a simple and inexpensive article for combination with a bottle to absorb liquid on the outside of a bottle, and which further adds visual appeal to the bottle.

Other objects will in part be obvious and will in part appear hereinafter.

SUMMARY OF THE INVENTION

Basically, the present invention includes a length of flexible cord made of liquid-absorbing material, and at least one retaining member having parallel passageways through which the cord passes, in frictional engagement with the passageways, in combination with a bottle having base and neck portions. In a first disclosed embodiment, the two ends of the cord are passed through the passageways, leaving a closed loop of cord on one side of the retaining member which is slid upon the cord to tighten the loop in substantially surrounding relation to the neck. The two ends of the cord are preferably about the same distance from the retaining member, and the portions of the cord between the ends and the retaining member extend down the base of the bottle. Weighted balls of diameter larger than the passageways may be affixed to the ends of the cord after passing the ends through the retaining means passageways to serve a number of functions such as preventing fraying of the cord ends, preventing separation of the cord and retaining member and adding weight to ensure that the cords extend neatly down the base of the bottle to add to the decorative effect.

Second and third embodiments are illustrated and described. In both of these embodiments, the closed loop on one side of the retaining member is again placed around the bottle in substantially surrounding relation to the neck. In the second embodiment, the cord portions extending from each passageway are passed around the bottle neck from the front side, i.e., the side where the retaining member is positioned, to the opposite side and back to the front side and looped over one another, or tied in a knot, on the front side directly below the retaining member, with the ends again extending down the base of the bottle. In the third embodiment, the cord is passed around the bottle neck in the same manner as in the second embodiment, but instead of looping or tying the cord to itself, a second retaining member, identical to the first, is provided; the cord ends are passed through the second retaining member which is positioned directly below the first on the front side of the bottle.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
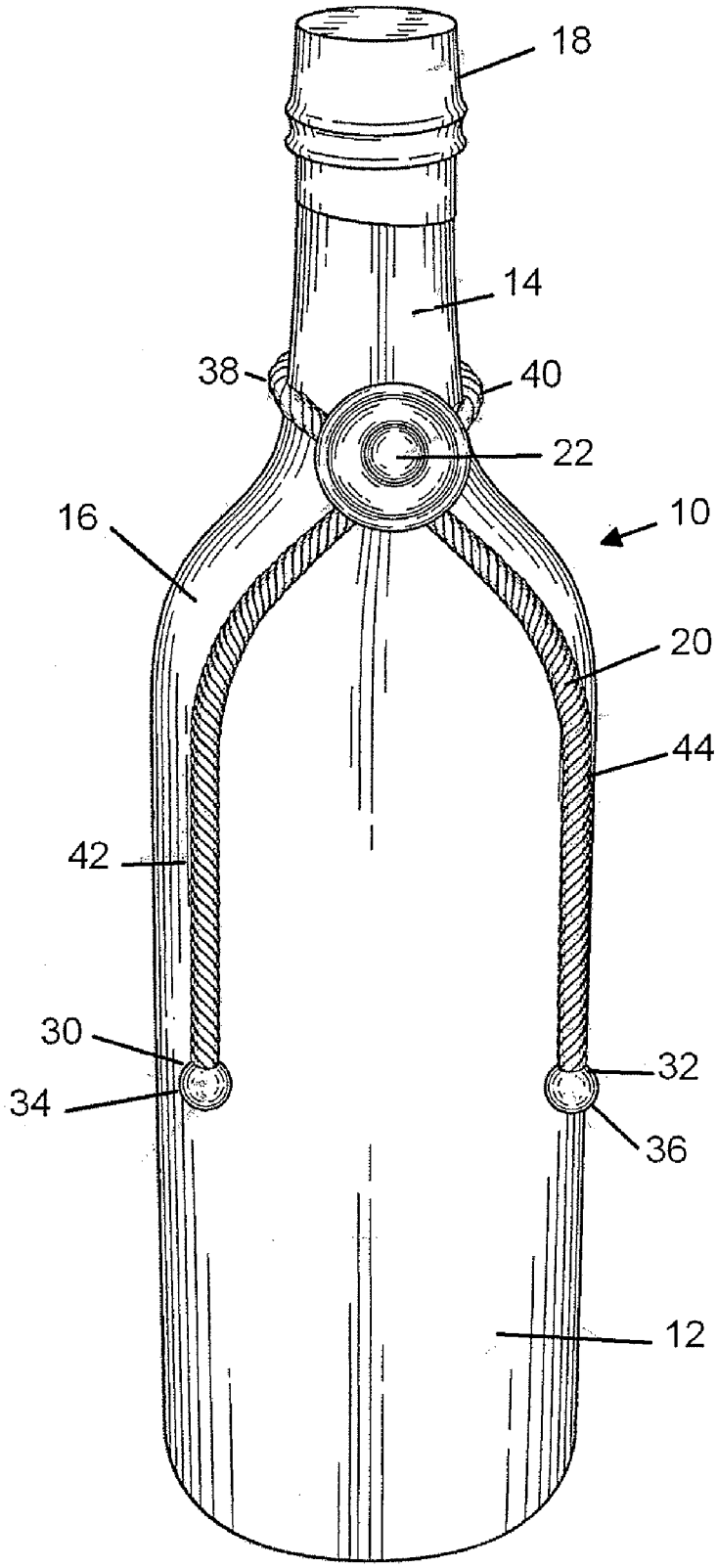
FIG. 1 is a perspective view of a first embodiment of the article of the invention in combination with a typical bottle of the type for which the invention is intended.
Figure 2:
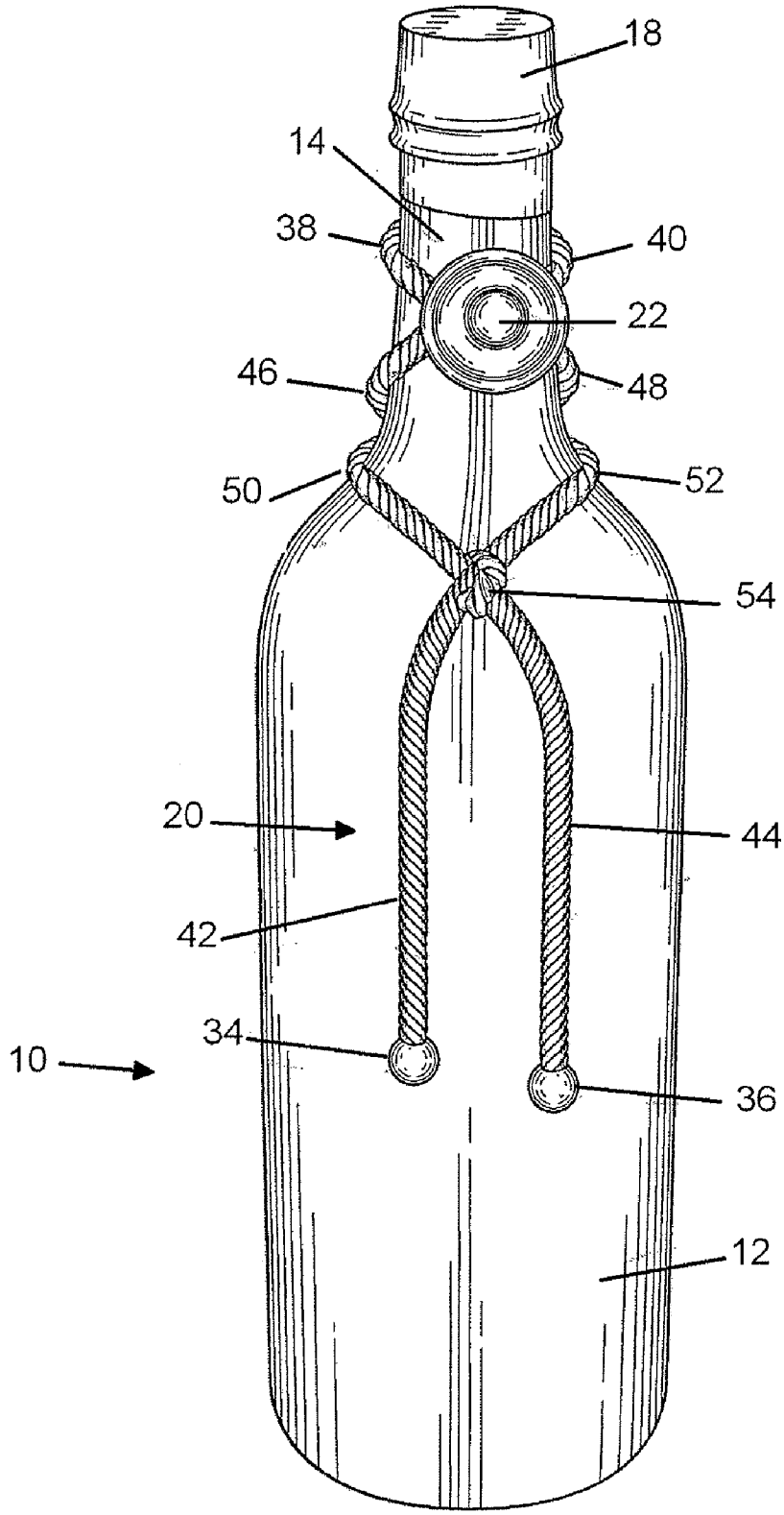
FIG. 2 is a perspective view of the bottle in combination with a second embodiment of the liquid-absorbing article.
Figure 3:
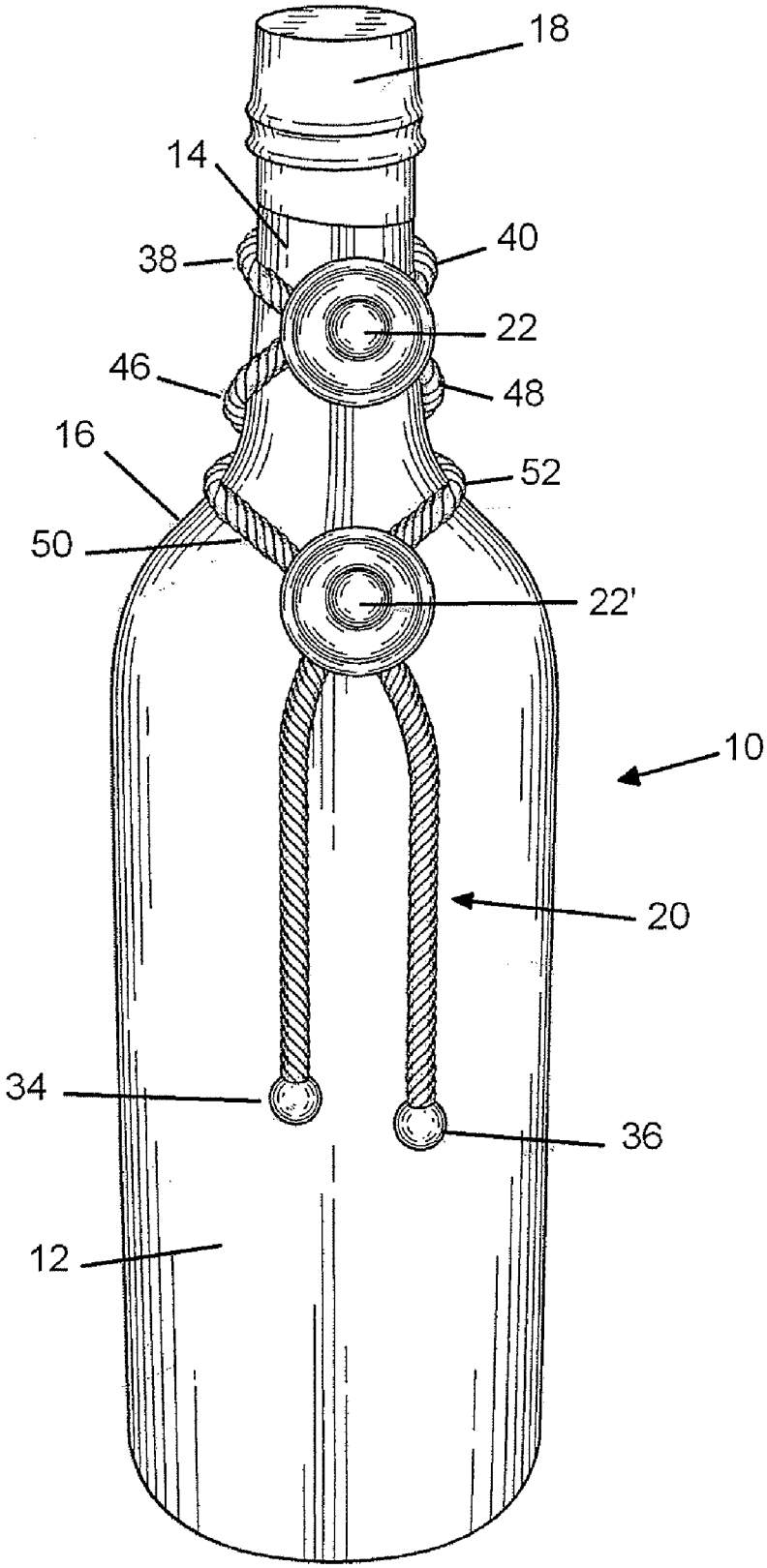
FIG. 3 is a perspective view of a third embodiment of the article and bottle combination.
Figure 4:
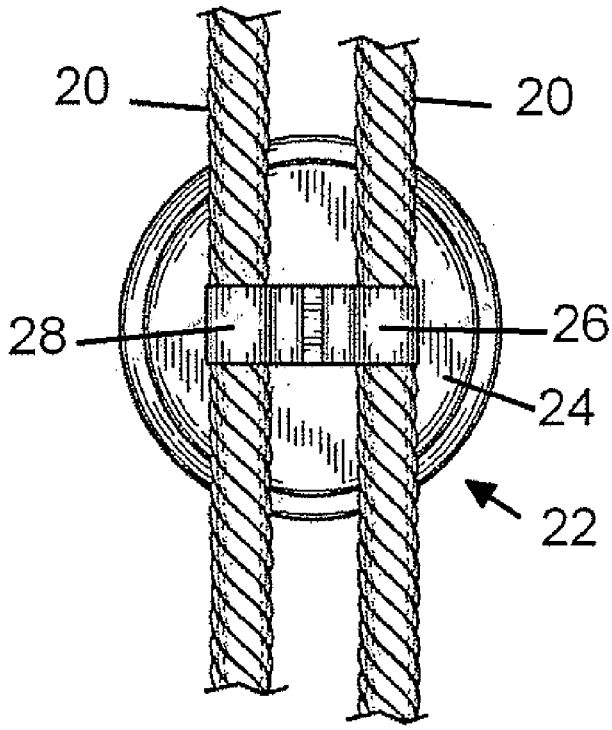
FIGS. 4 and 5 are rear and side elevational views, respectively, of the retaining member portion of the article with fragments of the cord extending therethrough.
Figure 5:
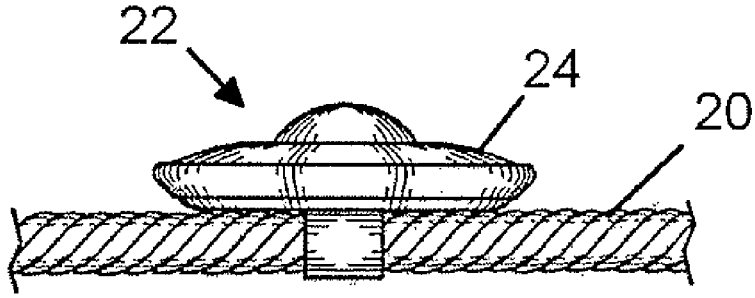

Referring now to the drawings, bottle 10 includes base portion 12, neck portion 14, of smaller diameter than the base portion, and intermediate portion 16, of varying diameter, where the base and neck are integrally merged. Bottle 10 includes the usual opening at the top of neck 14 through which a liquid which, for purposes of the present discussion, will be assumed to be wine, is placed into and poured from bottle 10. In FIGS. 1–3 sealing means 18, which may include a cork, covers the opening and is removed prior to pouring. The invention includes, in combination with bottle 10, an article designed to absorb wine which may run down the outside surface of the bottle following pouring of a portion of the wine and return of the bottle to an upright or semi-upright position. The article includes a length of flexible cord 20 and retaining member 22. As seen in FIGS. 4 and 5, retaining member 22 includes base 24, having a decorative forward surface and a pair of laterally adjacent, cylindrical passageways 26 and 28 affixed to its rear surface. Cord 20 is of a material which is liquid-absorbent, at least on its surface and preferably throughout, and includes opposite ends 30 and 32 which are contained within and hidden by balls 34 and 36, respectively, in the illustrated versions.

In assembly, ends 30 and 32 are passed through passageways 26 and 28, respectively, and balls 34 and 36 are then affixed. Cord 20 is of the same or slightly larger diameter as passageways 26 and 28, whereby the cord is frictionally engaged by the inner surfaces of the passageways, and the solid, larger diameter balls prevent withdrawal of the cord through the passageways. Portions 38 and 40 of cord 20 extend from passageways 26 and 28, respectively, and form a closed loop on one side of retaining member 22. Portions 42 and 44 extend from the other side of the retaining member and extend therefrom to ends 30 and 32, respectively, in the FIG. 1 embodiment wherein the closed loop formed by cord portions 38 and 40 is placed around neck 14, retaining member 22 is slid to tighten the loop around the neck, and cord portions 42 and 44 extend downwardly over base portion 12. With cord 20 in this position, bottle 10 may be opened and tipped to pour wine from the open end, returned to the illustrated upright position and all or substantially all wine which travels down the exterior surface of neck 14 will be absorbed by the portion of cord 20 encircling the bottle neck.

In the FIG. 2 embodiment, the portions of cord 20 extending from retaining member 20 on the side opposite the closed loop formed by portions 38 and 40, such portions being denoted by reference numerals 46 and 48, are passed from the front (illustrated) side of bottle 10 to the rear side, crossed over one another, and passed back to the front side. The cord portions passing from rear to front side are numbered 50 and 52, and are looped over, or (preferably) tied to form knot 54, from which portions 42 and 44 extend to ends 30 and 32, respectively. Knot 54 is replaced in the FIG. 3 embodiment by second retaining member 22', preferably identical to retaining member 22, the passage of cord 20 around bottle 10 being the same as in the FIG. 2 embodiment. In all three embodiments, balls 34 and 36 are of greater density than cord 20, preferably being spherical, metallic balls crimped to ends 30 and 32, thereby assisting in maintaining cord portions 42 and 44 in contact with, and extending directly down, base portion 12, as well as adding to the visual appeal of the article in association with the bottle, and in preventing separation of the cord and retaining member(s).

What is claimed is:

1. A drip stopping system for absorbing liquid which runs downwardly on the exterior surface of a bottle following the pouring of such liquid from the bottle, the bottle having a base portion, a neck portion integrally merged at one end with the base portion, and defining at the other end an opening through which such liquid may be placed within and poured from, said system comprising, in combination:

a) a flexible cord having first and second ends and a liquid-absorbing outer surface;

b) at least one retaining member defining a pair of laterally adjacent passageways with parallel axes;

c) said cord passing through, in frictional contact with, each of said passageways with both of said first and second ends on one side and a closed loop of said cord on the other side of said retaining member; and d) said closed loop passing around and substantially surrounding said neck portion of said bottle in contacting relation with said exterior surface thereof, whereby any liquid moving down said exterior surface, following pouring of liquid from said bottle and returning said bottle to an upright position, is absorbed by said cord, wherein the portions of said cord on the opposite side of said retaining member from said closed loop are passed around said neck portion, crossed over one another, and passed back to the same side of the bottle as said retaining member.

2. The drip stopping system of claim 1 wherein the portions of said cord which are passed back to the same side of the bottle as said retaining member are tied to one another, forming a knot in said cord.

3. The drip stopping system of claim 2 wherein said base portion is of greater diameter than said neck portion and said neck and base portions are integrally merged through an intermediate portion of varying diameter through an axial length of said bottle, and wherein said passageways contact said neck portion.

4. The drip stopping system of claim 3 wherein said knot rests upon said intermediate portion.

5. The drip stopping system of claim 1 wherein the portions of said cord which are passed back to the same side of the bottle as said retaining member are passed through the parallel passageways of a second retaining member.

* * * * *